United States Patent [19]

Ginther

[11] Patent Number: 4,586,404

[45] Date of Patent: May 6, 1986

[54] CONTAINER PAIL OPENER

[75] Inventor: Vern Ginther, Penticton, Canada

[73] Assignee: Ver-Nor Development Corporation, Canada

[21] Appl. No.: 642,172

[22] Filed: Aug. 20, 1984

[51] Int. Cl.[4] ..... B67B 7/00

[52] U.S. Cl. ..... 81/3.57; 81/3.56

[58] Field of Search ..... 81/3.55, 3.56, 3.57, 81/3.37, 3.27; 254/113; D8/40

[56] References Cited

U.S. PATENT DOCUMENTS

| | | | |
|---|---|---|---|
| D. 138167 | 6/1944 | Welch | 81/3.57 X |
| D. 244,575 | 6/1977 | Endres et al. | 81/3.57 X |
| 1,053,092 | 2/1913 | Garbeil | 81/3.57 |

FOREIGN PATENT DOCUMENTS

| | | |
|---|---|---|
| 265162 | 10/1926 | Canada . |
| 323123 | 6/1932 | Canada . |

*Primary Examiner*—Frederick R. Schmidt

*Assistant Examiner*—Debra S. Meislin

*Attorney, Agent, or Firm*—Kane, Dalsimer, Kane, Sullivan and Kurucz

[57] ABSTRACT

A hand-operated device for removing tight fitting removable container pail lids having a continuous, skirt-like flange downwardly depending from the annular portion to circumscribe the container pail when in position. The device has a body section of uniform cross-section with a rear handle end, an upper edge, a lower edge, a main fulcrum surface at the front end, and a notch in the upper edge of the body section. A flange-engaging member which is a plate having an aperture within which the main body section is received, is moveably seated in the notch. The plate has a forwardly and upwardly angled lower, flange-engaging lip which in operation engages the flange of the lid and when an upward movement is effected at the handle end, an outward distortion of the flange of the lid is effected thereby permitting the removal of the lid without having to cut its flange.

8 Claims, 3 Drawing Figures

CONTAINER PAIL OPENER

BACKGROUND OF THE INVENTION

This invention relates to a tool designed for the removal of lids for industrial containers. More particularly, the invention pertains to a tool for removal of a lid having a skirt-type peripheral flange fitted over the top of a container such as commonly is used by food distributors. The lid of this type of container is usually made of plastic and forms an extremely tight fit of the container.

Various types of leverage devices have been proposed for removing lids from containers. Some of these prior art devices consist of a handle, a fulcrum portion and a lid engaging member. Examples of such devices are illustrated in U.S. Pat. Nos. 3,872,745 of Sarza et al issued Mar. 25, 1975 and 4,216,685 of Taylor issued Aug. 12, 1980. Such devices are designed to remove plastic lids which are tightly fitted on a container or pail. However, it is difficult to remove such a lid even with such devices, without cutting the skirt or peripheral flange of the lid first and oftentimes thereby rendering the lid unusable. The present invention overcomes the difficulties of the known prior art devices and provides required flexibility during operation.

Patents of general background interest describing the general application of a fulcrum principle on lid removing devices include Canadian Pat. No. 265,162 of Hardiman issued Oct. 19, 1926 and Canadian Pat. No. 323,123 of J. E. Mayhew issued June 7, 1932.

SUMMARY OF THE INVENTION

According to the present invention there is provided an opener for removing from container pails tight fitting removable lids having annular elevated peripheral portions with skirt-type peripheral flanges. The device is also equally applicable for removing self-locking lids made of a strong plastic material for pails such as are sometimes used to contain paints, roofing compounds, adhesives and the the like. The opener comprises an elongated main body section of uniform cross-section having an upper edge, a lower edge, sides a front end and a rear handle end. A main fulcrum surface is secured to the main body section at the front end and situated with respect to the lower edge of the main body section so that, when the handle end of the opener is pried upwardly when in use, this fulcrum surface bears upon the body portion of the lid to be removed from the pail. A notch is situated in the upper edge of the main body section, extending transversely across it, near to the front end of the main body section. A flange-engaging member comprising a plate having an aperture through which the main body section is received is moveably seated in the notch on the main body section. The width of the notch is such that it provides for relative movement of the plate longitudinally within the notch with respect to the main body section. The plate has a forwardly and upwardly angled lower flange-engaging lip. The lip is positioned with respect to the main fulcrum surface and the lower edge of the main body section so that in operation, when it engages the flange of the lid and an upward movement is effected at the handle end of the main body section so that the main fulcrum surface bears on the body portion of the lid, the lower edge of the main body section in front of the plate will bear against the annular elevated peripheral portion of the lid. The lip of the plate will then move rearwardly to effect outward distortion of the flange of the lid thereby permitting the removal of the lid.

The apparatus according to the present invention has proven extremely effective, quick and flexible as an inexpensive tool for the non-destructive removal of a lid which is tightly held upon its container.

It is a principal object of the present invention to provide a lid removing opener that may be quickly and easily applied for use and by which the cover to which it is applied may be lifted from the container without causing damage either to the container or to the cover.

BRIEF DESCRIPTION OF THE DRAWINGS

These and other objects and advantages of the invention will become apparent upon reading the following detailed description and upon referring to the drawings in which.

Figure 1:
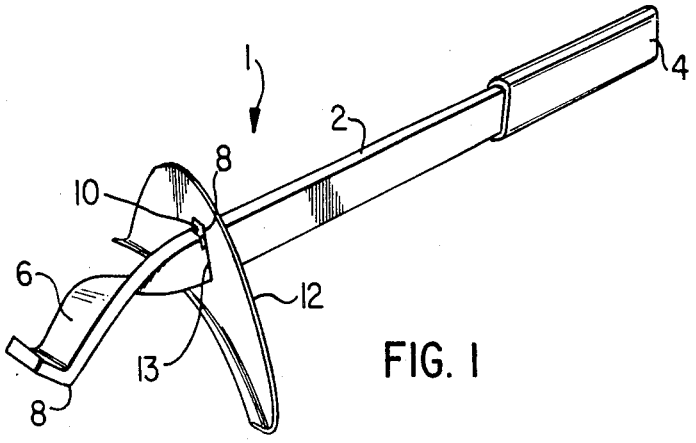
FIG. 1 is a perspective view of the opener of this invention.

While the invention will be described in conjunction with an example embodiment, it will be understood that it is not intended to limit the invention to such embodiment. On the contrary, it is intended to cover all alternatives, modifications and equivalents as may be included within the spirit and scope of the invention as defined by the appended claims.

DETAILED DESCRIPTION OF THE INVENTION

In the following description, similar features in the drawings have been given similar reference numerals.

Turning to FIG. 1 there is shown a perspective view of the container opener 1 according to the present invention. The opener is composed generally of a uniform main body section 2 having an elongated rear handle end 4 and integral therewith a main fulcrum body 6 which is twisted as shown with respect to the main body section 2. Main fulcrum body 6 is bent downwardly with respect to the main body section 2 and then upwardly to form a bend, the bottom of which forms the fulcrum surface 8. A notch 10 is situated at the top edge of the main body section 2 spaced from but proximal to the front end.

A flange-engaging plate 12 with a vertically oriented centrally located rectangular aperture 13, which is slightly bigger than the cross-section of the main body section 2 and within which the main body section 2 is received, is moveably seated in the notch 10. Bottom edge 14 of the plate 12 is curved to conform generally to the lateral curvature of the flanges of the container lids on which it is to be used and terminates with an upwardly and forwardly angled lip 16. Preferably, the width of the plate is such that the edge 14 will engage a reasonable portion of the lower edge of the flange 18 of the lid.

It is to be noted that the main body section 2 is of straight, uniform construction as this is the most preferable configuration. The container opener 1 can be constructed entirely of a strapping material and normally can be formed of a metal such as steel or iron.

Figure 2:
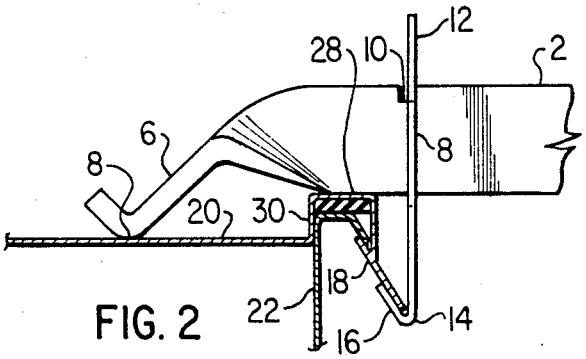
FIG. 2 is a side view in partial cross-section of an opener according to this invention in position to commence the opening operation of a container lid.
Figure 3:
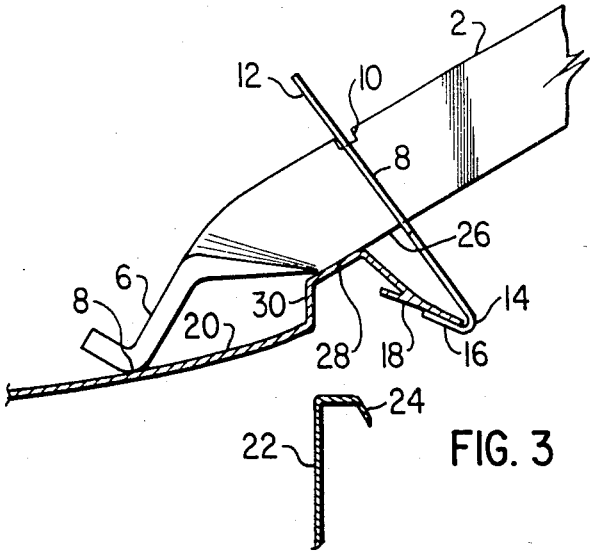
FIG. 3 is a side view in partial cross-section of the opener and lid of FIG. 2, the opener at a stage of removal of the lid.

With this particular construction, as seen in FIG. 2, lip 16 of the plate 12 can be readily inserted under flange 18 of the lid 20. In this position of operation, the fulcrum surface 8 rests right on the surface of the lid 20 and the bottom edge 26 of the main body section 2 rests right on the top of the elevated annular portion 28 of the flange of the lid 20. Therefore, by exerting a slight upward torque on the rear handle end 4, the outer edge lip 16 of the plate 12 pushes up and outwardly against the flange 18 while the bottom edge 26 of the main body section 2 applies pressure upon the top of the elevated annular portion 28 of the flange of the lip 20. This action causes the flange 18 of the lid 20 be an outwardly distorted thereby causing disassociation of the edge 24 of container 22 and lid 20, as shown in FIG. 3. In this operation, the bottom edge 26 of the main body section 2 functions as a second fulcrum surface. Hence it is important for the bottom edge 26 to sit on the top of the elevated annular portion 28 of the flange of the lid 20. This is accomplished by arranging the fulcrum surface 8 to be below the bottom edge 26 at a level equal to the height of elevation 30 of the elevated annular portion 28 of the flange of the lid. The width of the notch 10 longitudinally with respect to the main body section 2 is such that it provides sufficient clearance for the relative movement of the plate 12 longitudinally within the notch 10 in order to maintain a secured contact between the lip 16 and the flange 18 throughout the operation. This movement of the plate accommodates the natural outward distortion of flange 18 which occurs as the lid is being removed by the opener.

This procedure is to be repeated about the periphery of the lid until a sufficient portion of the flange 18 of lid 20 has been removed from the pail 22 in order to effect complete removal of the lid from the pail. It should be carefully noted that this is effected without cutting any portion of the lid 20 and without permanently distorting the top portion of the lid 20. This means that the lid 20 may be replaced on the pail 22 after partially using the contents thereof and since it is undistorted in its sealing area, it will form at least a dust-tight seal with the container. The contents are thus protected against contamination until such time as the contents are exhausted.

Thus it is apparent that there has been provided in accordance with the invention a container pail lid remover that fully satisfies the objects, aims and advantages set forth above. While the invention has been described in conjunction with a specific embodiment thereof, it is evident that many alternatives, modifications and variations will be apparent to those skilled in the art in light of the foregoing description. Accordingly, it is intended to embrace all such alternatives, modifications and variations as fall within the spirit and broad scope of the invention.

What I claim as my invention:

1. An opener for removing tight fitting, removable container pail lids, the lid being of the type including a central, circular body portion to cover a pail opening, a peripheral annular portion elevated with respect to the body portion and a continuous, circular skirt-like flange downwardly depending from the annular portion to circumscribe the container pail when in position, the opener comprising:

an elongated main body section of uniform cross-section and having an upper edge, a lower edge, sides, a front end and a rear handle end;

a main fulcrum surface secured to the main body section at the front end and situated with respect to the lower edge of the main body section, so as to bear upon the body portion of the lid to be removed from the pail when the handle end of the opener is pried upwardly when in use;

a notch extending transversely across the upper edge of the main body section spaced from but proximal to the front end thereof the notch being of predetermined width in the longitudinal direction of the main body section;

a flange-engaging member comprising a plate having an aperture within which the main body section is received, the plate being moveably seated in the notch on the main body section and having a forwardly and upwardly angled lower flange-engaging lip, the width of the notch being sufficient to provide relative movement of the plate in the longitudinal direction within the notch, with respect to the main body section, the lip being positioned with respect to the main fulcrum surface and lower edge of the main body section so that in operation when it engages the flange of the lid and upward movement is effected at the handle end of the main body section so that the main fulcrum surface bears on the body portion of the lid, the lower edge of the main body section in front of the plate will bear against the annular elevated peripheral portion of the lid, in operation the lip of the plate will move rearwardly to effect outward distortion of the flange of the lid thereby preventing removal of the lid.

2. An opener according to claim 1 wherein the main body section has a constant rectangular cross-section throughout most of its length, the upper and lower edges being of shorter cross-sectional dimension than the sides.

3. An opener according to claim 2 wherein the fulcrum surface is integrally connected to the main body section.

4. An opener according to claim 3 wherein the main fulcrum surface is formed by an integral extension to the elongated main body section at its front end, the extension having similar cross-section with respect thereto, the cross-sectional orientation at the main fulcrum surface being at a 90° angle to that of the main body section.

5. An opener according to claim 4 wherein the extension is bent downwardly with respect to the main body section, and its front end is bent upwardly to form a bend, the bottom of which forms the fulcrum surface.

6. An opener according to claim 3 wherein the aperture in the flange-engaging member is of rectangular shape corresponding to, but slightly larger than, that of the main body section so that the plate is removably seated in the notch on the main body section.

7. An opener according to claim 1 wherein the flange-engaging lip is curved to conform to the curvature of the flange of the lid.

8. An opener for removing tight fitting, removable container pail lids, the lid being of the type including a central, circular body portion to cover a pail opening, a peripheral annular portion elevated with respect to the body portion and a continuous, circular skirt-like flange downwardly depending from the annular portion to circumscribe the container pail when in position, the opener comprising:

an elongated main body section having an upper edge, a lower edge, sides, a front end and a rear handle end, the body section having a regular rectangular cross-section throughout most of its length, the upper and lower edges being of shorter cross-sectional dimension than the sides;

a main fulcrum surface being an integral extension to the elongated body section at its front end, the cross-sectional orientation at the main fulcrum surface being at a 90° angle to that of the main body section, the main fulcrum surface being situated with respect to the lower edge of the main body section so as to bear upon the body portion of the lid to be removed from the pail when the handle end of the opener is pried upwardly when in use;

a notch extending transversely across the upper edge of the main body section spaced from but proximal to the front end thereof, the notch being of predetermined width in the longitudinal direction of the main body section;

a flange-engaging member comprising a plate having a vertical aperture within which the main body section is received, the aperture being of rectangular shape corresponding to, but slightly larger than that of the main body section to be removably seated in the notch on the main body section, the plate being moveably seated in the notch on the main body section and having a forwardly and upwardly angled lower, flange-engaging lip curved to conform to the curvature of the flange of the lid, the width of the notch being sufficient to provide relative movement of the plate in the longitudinal direction within the notch, with respect to the main body section, the lip being positioned with respect to the main fulcrum surface and lower edge of the main body so that when it engages the flange and an upward pressure is applied to the handle end of the main body section, the lower edge of the main body section in front of the plate will bear against the annular elevated peripheral portion of the lid, in operation the lip of the plate will move rearwardly to effect outward distortion of the flange of the lid as the handle end is pried upwardly and with the main fulcrum surface pivoting on the body portion of the lid, thereby permitting removal of the lid.

* * * * *